US009959748B2

(12) United States Patent
Moffa

(10) Patent No.: US 9,959,748 B2
(45) Date of Patent: May 1, 2018

(54) FIRE DETECTION SYSTEM WITH SELF-TESTING FIRE SENSORS

(71) Applicant: Tyco Fire & Security GmbH, Neuhausen am Rheinfall (CH)

(72) Inventor: Anthony Philip Moffa, Northborough, MA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days. days.

(21) Appl. No.: 15/088,618

(22) Filed: Apr. 1, 2016

(65) Prior Publication Data

US 2017/0287318 A1 Oct. 5, 2017

(51) Int. Cl.
*G08B 29/00* (2006.01)
*G08B 29/04* (2006.01)
*G08B 29/14* (2006.01)

(52) U.S. Cl.
CPC ..... *G08B 29/043* (2013.01); *G08B 29/145* (2013.01)

(58) Field of Classification Search
CPC ..... G08B 29/145; G08B 29/14; G08B 29/12; G08B 17/00; G08B 29/185; G08B 17/107; G08B 29/04; G08B 29/043; G08B 17/113
USPC ..... 340/514, 516, 630, 628, 517, 506
See application file for complete search history.

(56) References Cited

U.S. PATENT DOCUMENTS 6,225,910 B1 * 5/2001 Kadwell ..... G08B 17/107 250/573
6,396,405 B1 * 5/2002 Bernal ..... G08B 17/107 250/574
2010/0271220 A1 * 10/2010 Pattok ..... G08B 3/10 340/628
2012/0050030 A1 * 3/2012 Murphy ..... G08B 17/107 340/514
2012/0235822 A1 * 9/2012 Barson ..... G08B 17/107 340/630

* cited by examiner

*Primary Examiner* — Anh V La
(74) *Attorney, Agent, or Firm* — HoustonHogle LLP

(57) ABSTRACT

The system and method provide for the monitoring and trending the rate at which fire detection devices get dirty. This information is used to determine which devices are clogged or getting clogged and to establish that the chambers are open to air flow because they are accumulating dirt over time. Air flow through the detection chamber is proven using this analysis. Further self-testing is also employed for the fire detection devices by including modules that simulate the smoke interference with the light. This can be accomplished in two ways. In one example, light from the chamber light source can be reflected toward the scattered light photodetector to simulate alarm conditions. In another example, an additional chamber light source can be added to the detection chamber that can generate light to simulate alarm conditions.

22 Claims, 13 Drawing Sheets

FIRE DETECTION SYSTEM WITH SELF-TESTING FIRE SENSORS

BACKGROUND OF THE INVENTION

Fire detection systems are often installed within commercial, residential, educational, or governmental buildings, to list a few examples. These fire detection systems typically include control panels and fire detection devices, which monitor the buildings for indicators of fire. In one example, the fire detection devices are individually addressable smoke detectors that are part of a network. Other examples include networks of stand-alone detectors with no control panel.

One common type of fire detection devices are photoelectric (or optical) smoke detectors. The optical smoke detectors often include a baffle system, which defines a detection chamber, to block ambient light while also allowing air to flow into the detection chamber. The optical smoke detectors further include a smoke detection system within the detection chamber for detecting the presence of smoke. The smoke detection system typically comprises a chamber light source and a scattered light photodetector. When smoke fills the detection chamber it causes the light from the chamber light source to be scattered within the chamber and detected by the scattered light photodetector. When no smoke or other scatter medium is present, the photodetector only receives a small background signal from the light source.

In many systems, the fire detection devices send event data, characterizing the level of detected scatter light for example, to the control panel. There the event data is analyzed. The panel will cause an alarm if the smoke exceeds a threshold, for example. In other examples, this analysis is performed on the detector itself, or a hybrid of on-detector and on-panel analysis.

As air flows through the detection chamber over time, dirt and dust can accumulate inside and around the detection chamber. This is especially true for fire detection devices installed in harsh environments such as kitchens or rooms with cigarette smoke. Additionally, it is not uncommon for insects or spiders to build nests or webs in or on the detectors. Even in devices installed in environments that are not considered harsh (such as offices), dirt and dust gradually accumulate inside the detection chamber. Typically, as dirt or dust accumulates inside the detection chamber, the background signal level increases.

Currently, building codes require that the fire detection systems be tested annually. This annual testing is performed because these fire detection devices have a number of different failure modes. For example, the electronics or optics of the device can fail. Likewise, the devices can become so dirty that the baffle systems become clogged. Additionally, it is not uncommon for the fire detection devices to get painted over.

The annual testing of the fire detection devices is commonly performed by a technician performing a walkthrough test. The technician walks through the building and manually tests each of the fire detection devices of the fire detection system. In the case of smoke detectors, the technician often uses a special testing device including an artificial smoke generating apparatus housed within a hood at the end of a pole. The technician places the hood over the fire detection device and the artificial smoke generating device releases artificial smoke near the detector. If the smoke detector is functioning properly, it will trigger in response to the smoke. The technician repeats this process for every smoke detector of the fire alarm system.

On the other hand, self-testing fire detection devices have been proposed. In one specific example, a self-test circuit for a smoke detector periodically tests whether the sensitivity of a scattered light photodetector is within a predetermined range of acceptable sensitivities. If the sensitivity of the scattered light photodetector is out of the predetermined range of acceptable sensitivities, then a fault indication is produced.

SUMMARY OF THE INVENTION

One type of fire detection device, conventional optical smoke detectors, works on the principle of smoke interfering with a light source in a dark chamber. A prerequisite to the device operating is for air to flow freely through the chamber. This creates a challenge, however, as on the one hand the design needs to be closed to restrict light from entering the chamber, yet on the other hand, it needs to be open enough for air to flow freely through it.

The designs currently in use have resolved this challenge of keeping light out while allowing air in, with an intricate framework of filters, channels and mazes. These structures, however, raise the risk that dirt may ultimately clog the channels and reduce or restrict the air flow through the detection chamber of the fire detection device, eventually making it inoperable. The resulting test standards therefore require devices to be tested every year, for example, by external injection of smoke or smoke like material to prove that air still flows through the system.

While this process of injecting smoke or smoke like material into the fire detection device does in fact prove that air flows through it, it does not give an indication of the airflow rate, as the injected smoke is not metered. A technician could simply expose the device to any amount of smoke until it goes into alarm. A potentially bigger issue is that the material typically used to simulate smoke is an oily aerosol that adheres to the external and internal surfaces of the fire detection device, making surfaces more likely to attract and hold dirt.

The current method for manually testing fire detection devices of a fire detection system is also labor intensive. The technician must walk through the building and manually test each fire detection device of the fire alarm system. This time consuming method is often disruptive to occupants or employees of the building.

On the other hand, a problem with current self-testing devices is that the devices do not fully validate their operation. That is, the devices only test whether individual components of the devices are working or are within an acceptable range of acceptable sensitivities. It is possible to have a scenario in which a fire detection device "passes" a self-test, but has clogged pathways through the baffle system. In this scenario, the fire detection devices would appear to be fully operational, but in reality, the fire detection device is not able to detect smoke, for example.

It has been observed that monitoring and trending the baseline background signal levels of the scattered light photodetector of a fire detection device over extended timeframes makes it possible to observe and predict the rate at which dirt accumulates. While dirt accumulation is proportional to the sensor application (e.g. devices in operating rooms get dirty slower than detectors in boiler rooms), the rate over time is influenced by the airflow in the room and ultimately through the detection chamber. Clogged fire detection devices will not let air flow through them and therefore their baseline light detection levels will remain constant. Additionally, changes in the rate of change in the background signal over two weeks, or two months, or over a year for example, indicate that air flow through the detection chamber has changed and that the chamber may now be partially of fully blocked. By monitoring and trending the rate at which a device gets dirty, it is also possible to determine which devices are clogged or getting clogged. Conversely, it is also possible to establish that the chambers are open to air flow when they are accumulating dirt over time.

Once air flow through the detection chamber is proven using this analysis, the process of self-testing a fire detection device becomes an exercise in simulating the smoke interference with the light. This can be accomplished in two ways. In one example, light from the chamber light source can be reflected toward the scattered light photodetector to simulate alarm conditions. In another example, an additional chamber light source can be added to the detection chamber that can generate light to simulate alarm conditions.

In general, according to one aspect, the invention features a fire detection system. This system includes fire detection devices comprising detection chambers and an analytics system for analyzing performance of the detection chambers of the fire detection devices and determining whether the detection chambers are open to the flow of air from the ambient environment.

In embodiments, the analytics system tracks the performance of the detection chambers over time and determines whether the detection chambers are potentially blocked (for example, based on a static baseline signal or a negative change in the rate of change in the baseline al). Additionally, the fire detection devices are photoelectric smoke sensors that include a self-testing subsystem.

In one example, the self-testing subsystems of the fire detection devices includes a module for changing the light received by the photodetector in a manner consistent with the presence of smoke. In embodiments, the module can be an additional light source or a movable reflective surface. Additionally, the module can be manually triggered by a tool or magnet, or remotely triggered from a control panel.

In general, according to another aspect, the invention features a method for testing a fire detection system. The method includes analyzing the performance of the detection chambers of the fire sensors over time, determining whether the detection chambers are open to the flow of air from the ambient environment, initiating a self-test of a photoelectric detection circuit, and using the results to pass or fail the fire sensors.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1:
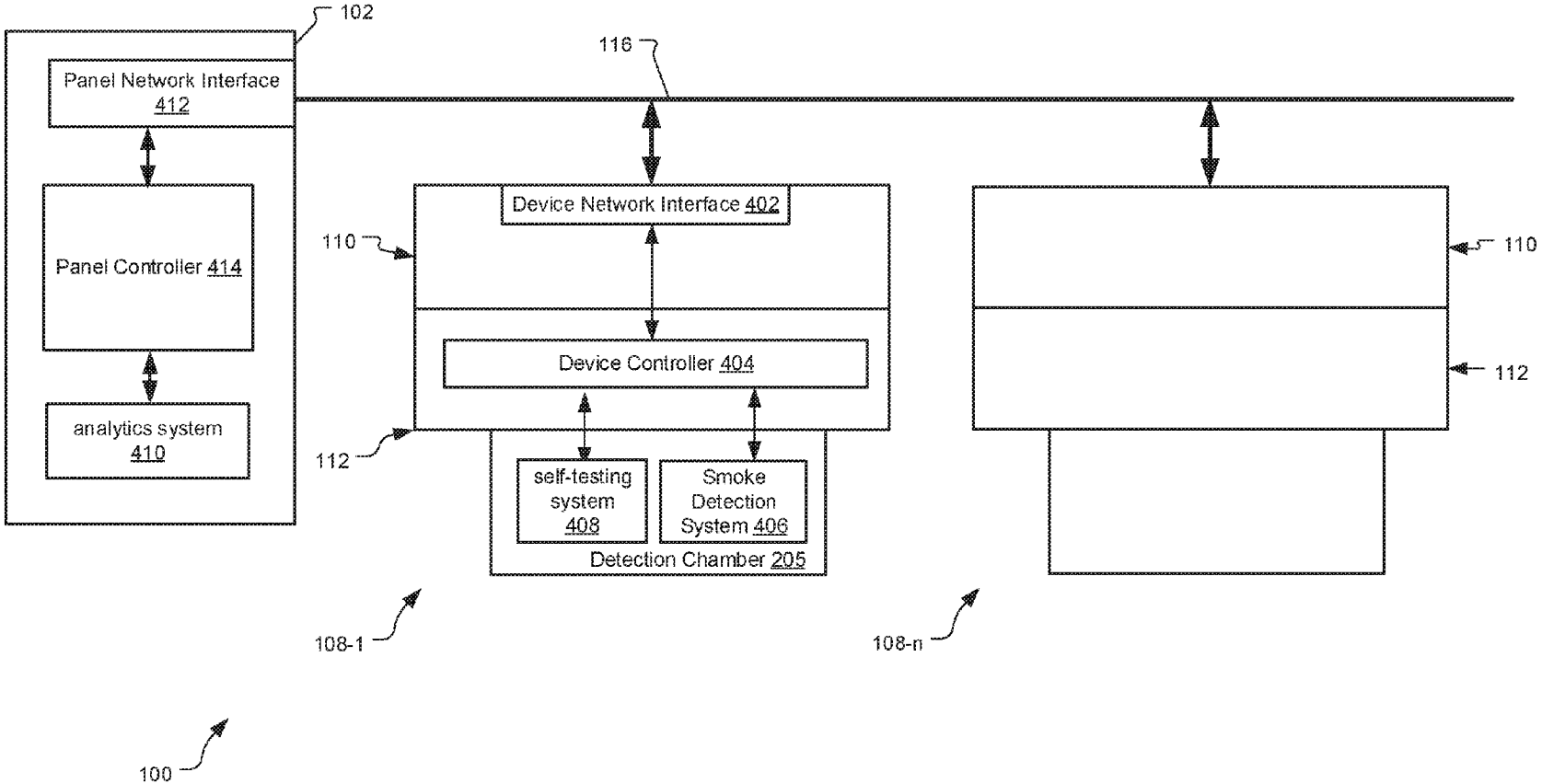
FIG. 1 is a block diagram of a fire detection system.

FIG. 1 is a block diagram of a fire detection system 100 that includes a control panel 102 and fire detection devices 108-1 to **108-*n*. The fire detection system 100** would typically be installed within a building, which could be residential, commercial, educational or governmental. Some examples of buildings include hospitals, warehouses, retail establishments, malls, schools, or casinos, to list a few examples. While not shown in the illustrated example, fire alarm systems typically include other fire detection or annunciation/notification devices such as carbon monoxide or carbon dioxide detectors, temperature sensors, pull stations, speakers/horns, and strobes, to list a few examples.

Each fire detection device 108 includes a base unit 110 and a head unit 112. A device network interface 402 is housed within the base unit 110, typically. The device network interface 402 enables the fire detection device 108 to communicate with the control panel 102 via a safety and security interconnect 116, such as addressable loop or a SLC (signal line circuit), to list a few examples. The safety and security interconnect 116 supports data and/or analog communication between the devices 108 and the control panel 102.

In other examples, the fire detection devices are more stand-alone devices, with no control panel.

A device controller 404 is housed in the head unit 112 of the fire detection device 108. The device controller 404 drives a smoke detection system 406 and a self-testing system 408, both of which are located within a detection chamber 205.

The control panel 102 includes a panel network interface 412 which enables the control panel 102 to communicate with the fire detection devices 108 via the safety and security data interconnect 116. The control panel 102 receives event data from the fire detection devices 108. Typically, the event data include a physical address of the activated device, a date and time of the activation, and at least one analog value directed to smoke levels or background light levels, and possibly ambient temperature detected by the fire detection device. Light levels detected by the scattered light photodetector 220 of each fire detection device 108 is also communicated to the control panel 102. The data received by the control panel 102 is saved in memory and communicated to an analytics system 410.

The analytics system 410 in some examples is implemented as a process that runs on the panel controller 414. In other examples, it is a separate system, possibly housed in the control panel 102. In still other examples, the panel controller 414 forwards device event data over network(s) (possibly including the Internet) to the analytics system that is implemented as a cloud system, for example. Such a cloud analytics system is often maintained by a business entity that is different from the owner of the fire detection system, such that the owner of the fire detection system is a client of the owner of the cloud analytics system.

Figure 2A:
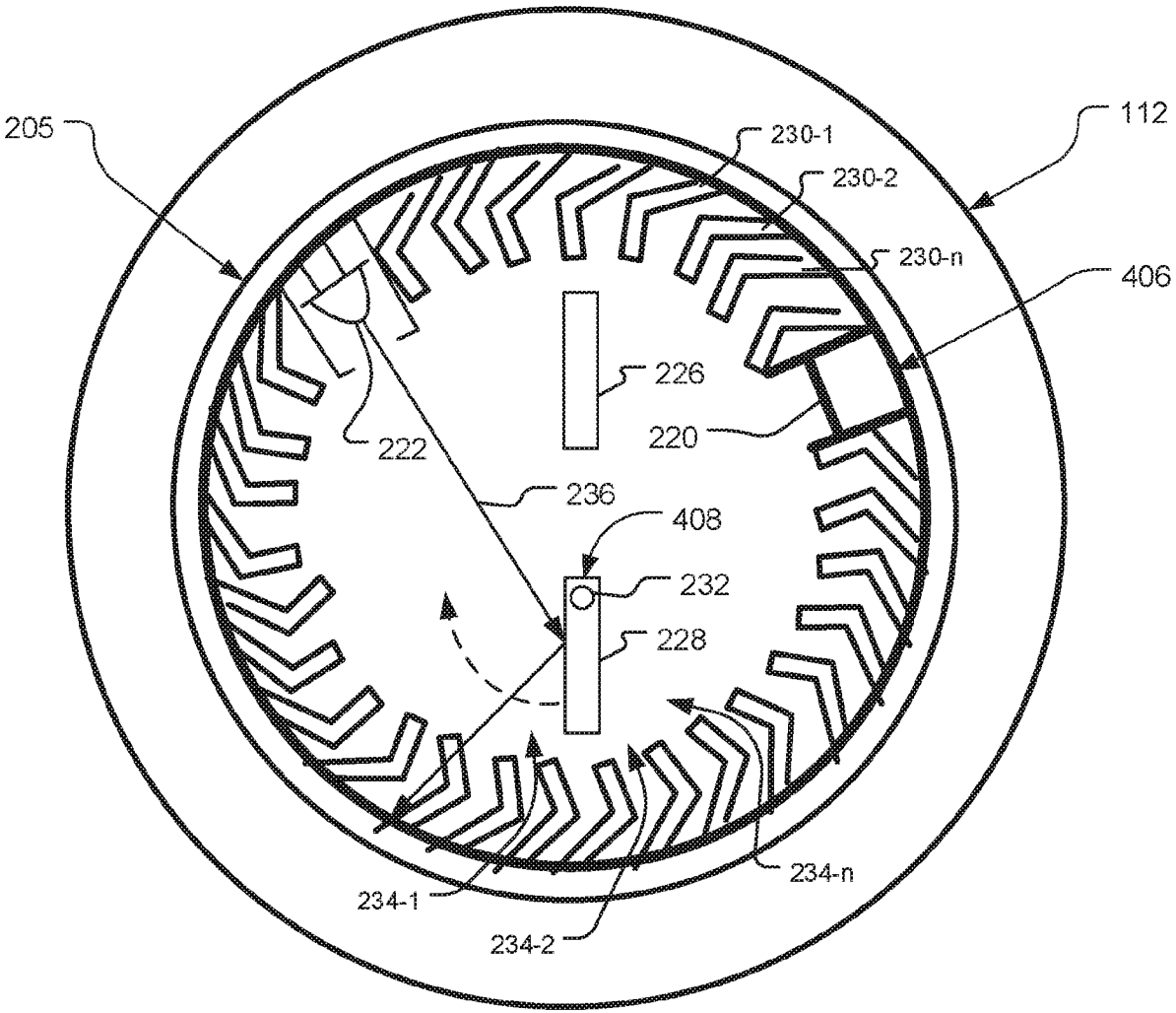
FIG. 2A is a plan view of a detection chamber in a fire detection device, illustrating an example of a self-testing system including a reflective surface, in which the device is in an operating state.

FIG. 2A is a plan view of an example detection chamber 205 in the head unit 112 of the fire detection device 108.

The detection chamber 205 is defined by the baffle system 230, which includes individual baffles 230-1 to **230-*n*. The arrangement of the baffles 230-1 to 230-*n* form channels or pathways 234-1 to 234-*n* that allow air, smoke, and also dirt and dust to flow through to the detection chamber 205**. The baffles are also commonly referred to as vanes, walls, or labyrinths, to list a few examples.

The smoke detection system detects the presence of smoke within the detection chamber 205. In the illustrated example, the smoke detection system comprises a chamber light source 222 for generating light and a scattered light photodetector 220 for detecting light that has been scattered due to the smoke or other scattering medium collecting within the detection chamber 205.

If smoke is present in the detection chamber 205, the light from the source 222 is reflected and scattered by the smoke and detected by the scattered light photodetector 220. A blocking baffle 226 is installed within the detection chamber 205 to prevent the light from having a direct path to the scattered light photodetector 220.

The self-testing system 408 is used to determine whether the smoke detection system 406 is operating normally. In general, the self-testing system 408 simulates the presence of smoke by generating or directing light into the visible path of the photodetector 220 to simulate the conditions of light being scattered by smoke and detected by the light photodetector 220. In this way the operation and sensitivity of the photodetector 220 can be tested.

In one embodiment of the self-testing system 408, a reflective surface 228, which is a small, slightly opaque plastic or glass film, is interjected into the light path 236 generated by the light source 222 such that the scattered light photodetector 220 detects a step change in light consistent with a smoke event. In the illustrated example, the reflective surface 228 is rotated around a pivot 232. In one embodiment, the reflective surface 228 can be interjected into the light path 236 with an Allen key or similar tool inserted into the base of the detector. In another embodiment, a magnet can be used to move the reflective surface 228. In yet another embodiment, the control panel 102 can remotely trigger a relay or stepper motor which in turn moves the reflective surface 228. In a further aspect, the command to trigger the self-test can be initiated by a cloud system and sent to the control panel.

In the illustrated example, the smoke detection system 406 is in an operating state. Therefore, the reflective surface 228 of the self-testing system 408 is reflecting the light 236 away from the light photodetector 220.

Figure 2B:
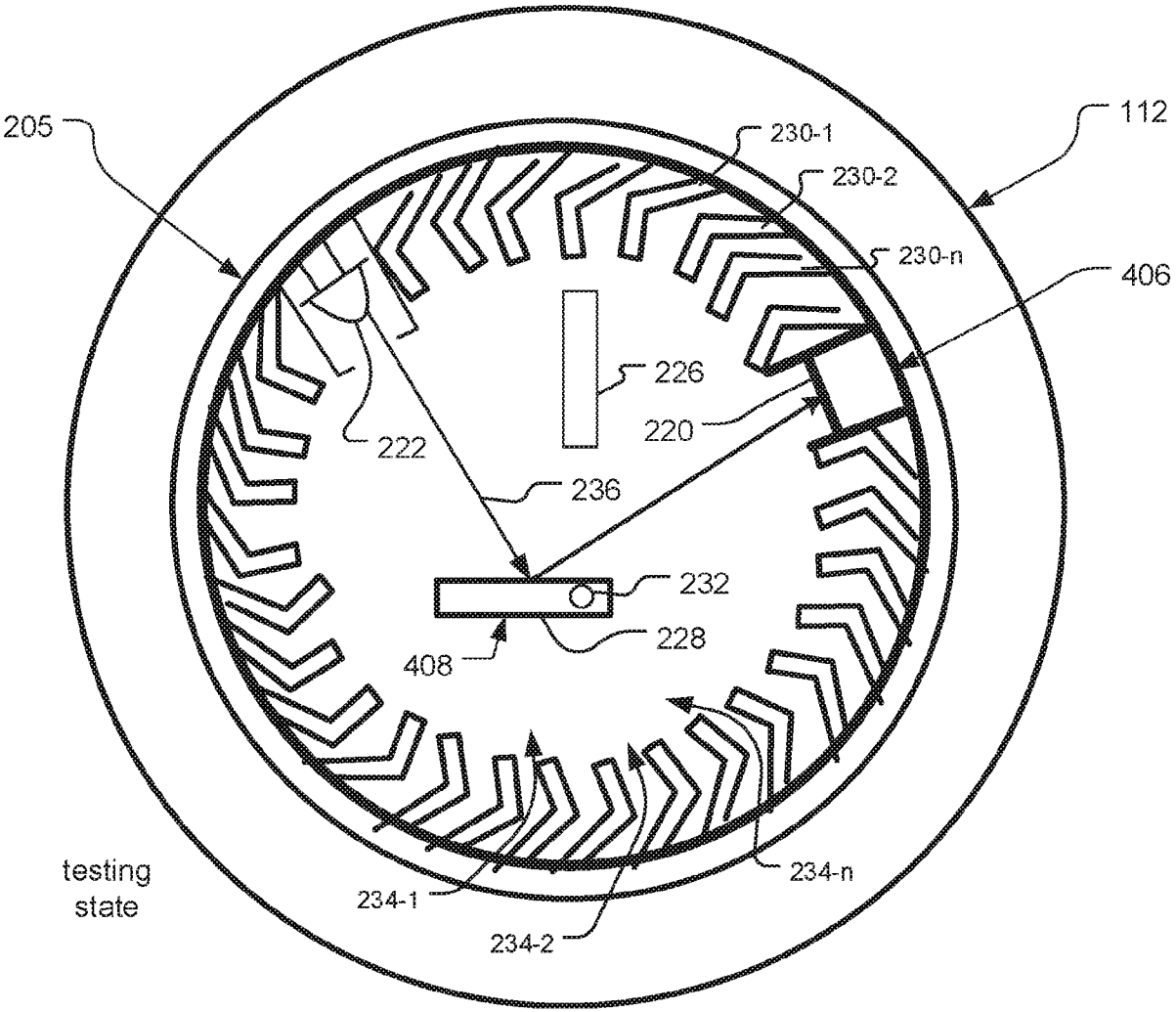
FIG. 2B is a plan view of a detection chamber in a fire detection device, illustrating an example of a self-testing system including a reflective surface, in which the device is in a testing state.

FIG. 2B illustrates an example of the smoke detection system 406 when it is in a testing state. The reflective surface 228 of the self-testing system 408 has been rotated around the pivot 232 such that the light 236 is directed toward the light photodetector 220, which would cause the fire detection device 108 to signal to the control panel 102 that the presence of smoke was detected. A combination of the surface finish, opacity and angle of the reflective surface 228 will permit for varying degrees of light to be received by the photodetector 220. In one example, the angle at which the reflective surface is set is dictated by a command from the control panel 102.

An alternative embodiment of the self-testing system 408, a second light source is placed in the detection chamber 205 such that the light is injected into the entrance aperture of the light photodetector 220. The second light source can then be covered with a diffuser (so as to remove any point source effect and soften the light). Since only a small percentage of the original light source is required, this second light is much smaller and lower in intensity. During normal operation, the second light is off completely. During testing, the second light can be stepped through various light intensities, proportional to predefined smoke obscuration levels.

In one implementation, the test sequence is structured to either put the detector into alarm (by reaching an obscuration level above the current alarm level set for the detector) or is done at a level slightly below the alarm level so as to achieve a pre-alarm response. In this way, different intensities of light would correlate directly to smoke obscuration levels and would permit for the creation of a sensitivity benchmark as well as testing pre-alarm levels, which are levels of light below the predetermined threshold at which the presence of smoke is determined.

Figure 3A:
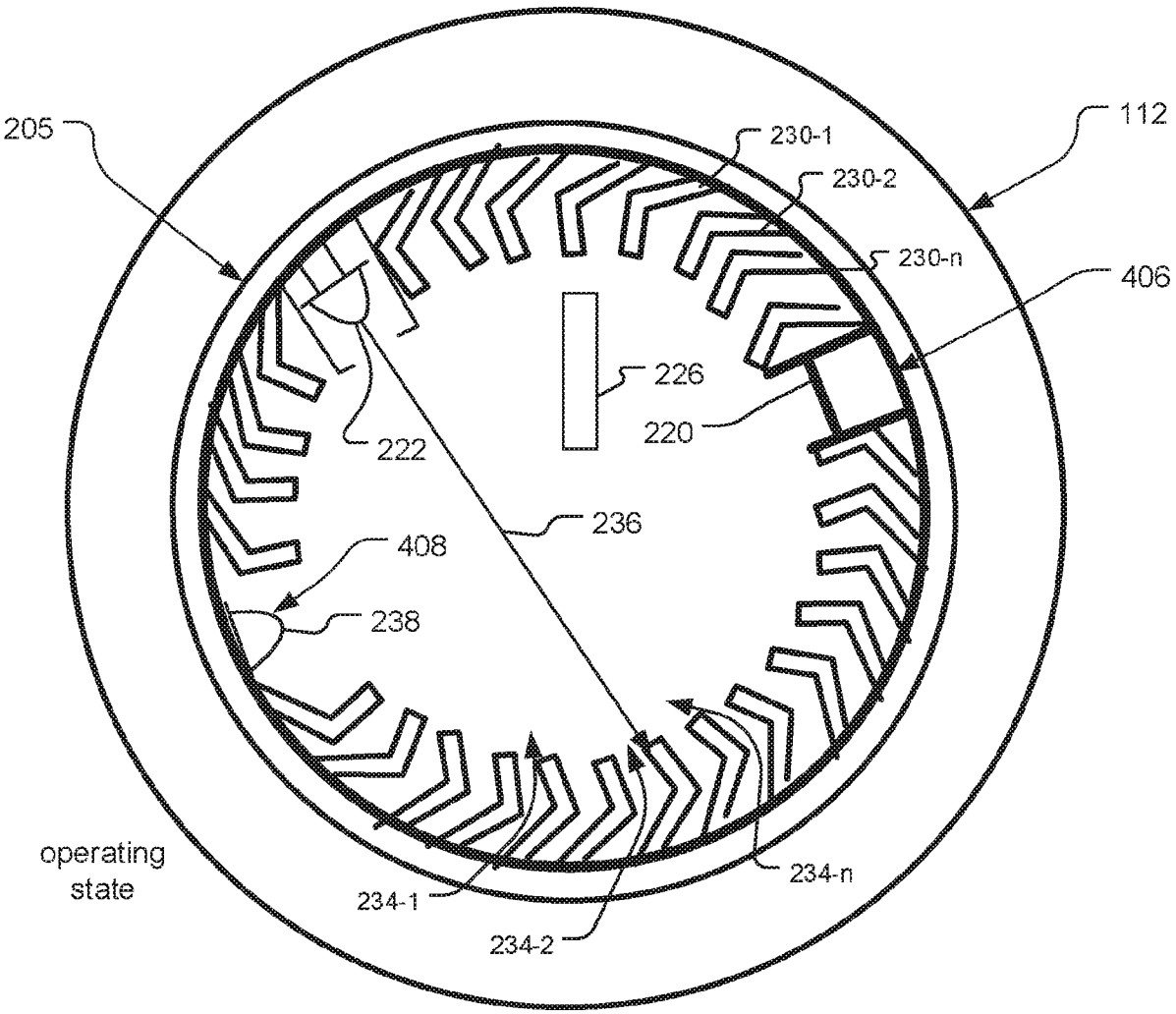
FIG. 3A is a plan view of a detection chamber in a fire detection device, illustrating an example of a self-testing system including a testing light source, in which the device is in an operating state.

FIG. 3A illustrates the alternative embodiment of the self-testing system 408 in which a second light source 238 is placed in the detection chamber 205. In this embodiment, the detection chamber 205 includes the testing light source 238, which is a small dimmable light source in a direct path to the light photodetector 220. In the illustrated example, the smoke detection system 406 is in an operating state. Therefore, the testing light source 238 is not generating light.

Figure 3B:
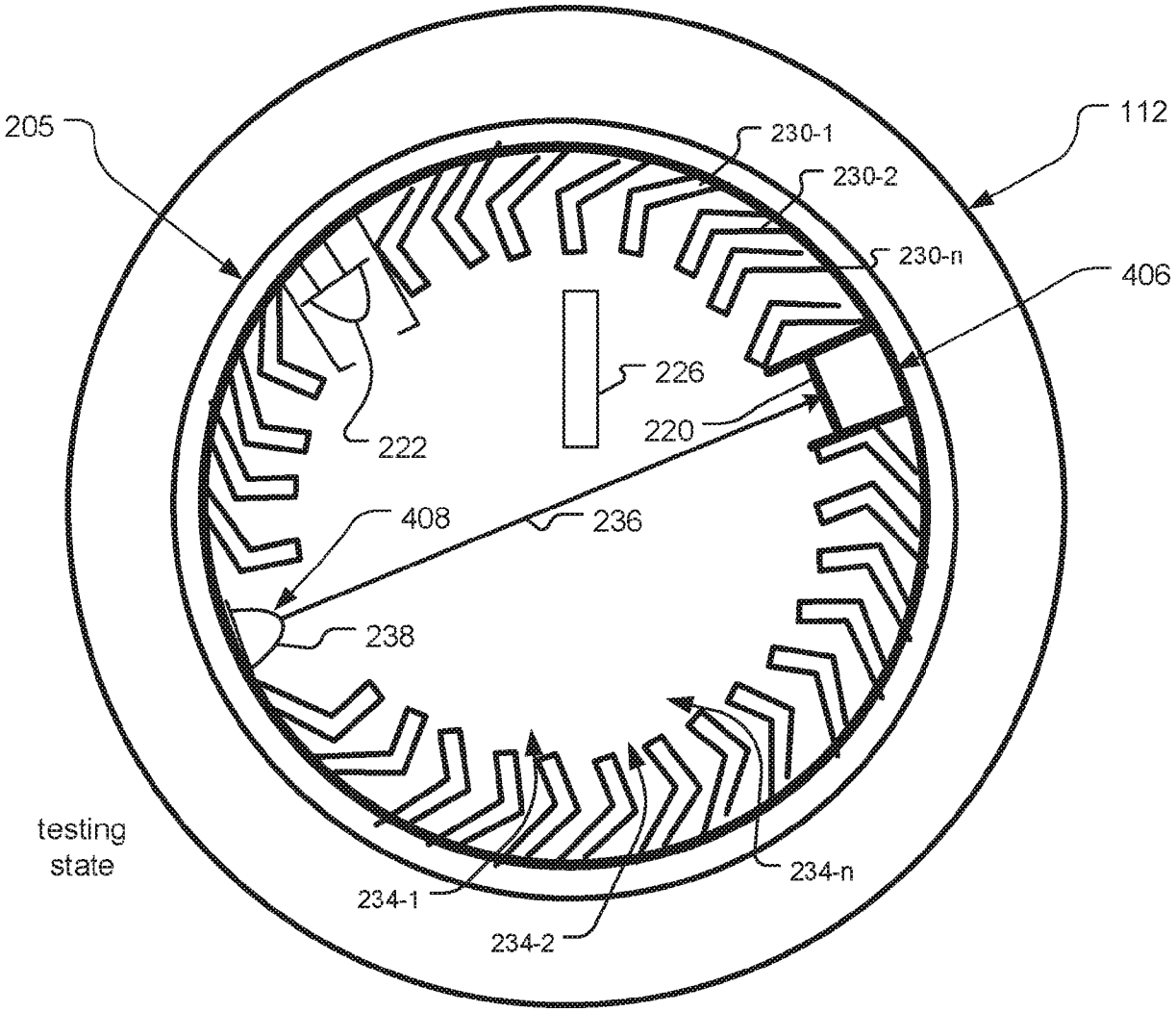
FIG. 3B is a plan view of a detection chamber in a fire detection device, illustrating an example of a self-testing system including the testing light source, in which the device is in a testing state.

FIG. 3B illustrates an example of the smoke detection system 406 with a testing light source when it is in a testing state. The testing light source 238 generates light 236 that is detected by the light photodetector 220. In one example, the intensity of the light 236 is high enough to cause the fire detection device 108 to enter an alarm state and signal to the control panel 102 that the presence of smoke is detected. In another example, the testing light source 238 generates light 236 below the alarm level of the device, in which case the level of light detected is communicated with the control panel 102 but the device does not enter an alarm state.

Figure 4:
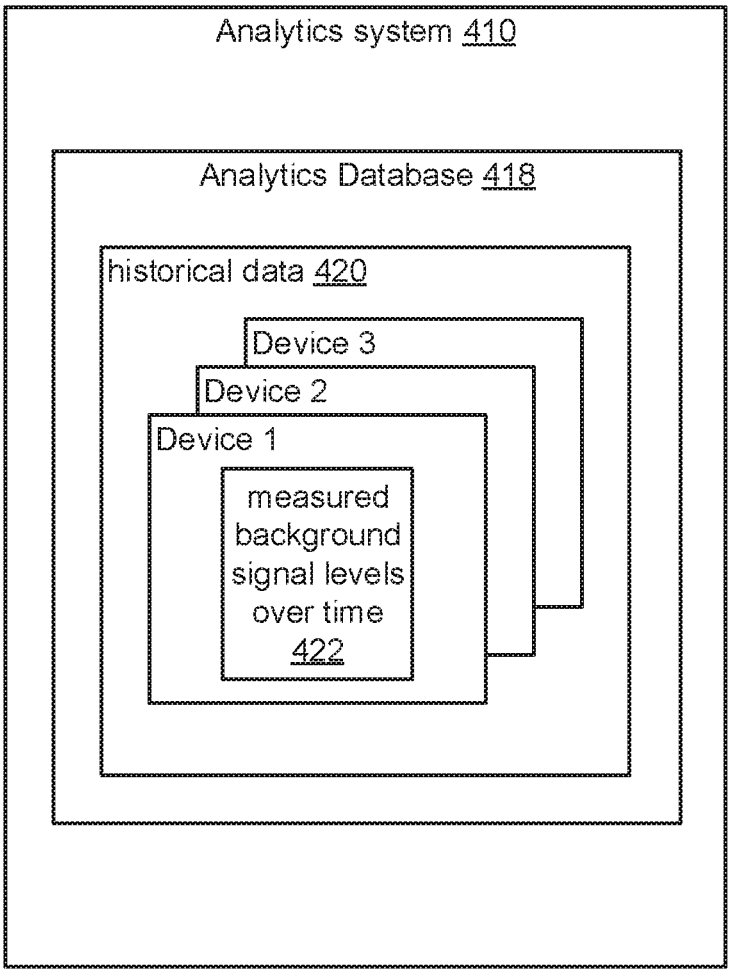
FIG. 4 is a block diagram of the analytics system, which can be part of the fire detection device, incorporated into a control panel, or implemented at a remote cloud system, which controls the control panel.

FIG. 4 is a block diagram of the database maintained by the analytics system 410. Specifically, the analytics system 410 includes an analytics database 418, which includes historical data 420. The historical data 420, in turn, includes measured background signal levels over time 422 for each fire detection device 108 monitored by the control panel 414.

The background signal level (also referred to as baseline signal) of a fire detection device 108 is the level of light detected by the light photodetector 220 in its operating state, when there is no smoke scattering the light within the detection chamber 205, nor any light being intentionally directed toward the light photodetector 220 as in the testing state. For example, the background signal level over the course of a day would be calculated from the lowest level background signal levels detected, excluding any short term (minute long or hour long) temporal spikes in the background signal due to transient effects such as short term presence of low levels of smoke.

The background signal level of a fire detection device 108 will change over time, such as over a month, a 6-month period, a year or several years. As air flows through the detection chamber 205, dirt and dust particles accumulate within the chamber, causing the surfaces of the detection chamber to become dirty. The increased dirt and dust scatter the light within the detection chamber 205, causing small increases in the amount of light detected by the scattered light photodetector 220 from the light source 222. Because the accumulation of dirt and dust is typically gradual, it is possible to differentiate the increase in the light level due to dirt and dust from that caused by the presence of smoke, which causes a very rapid increase in light levels. Typically, the measured background signal levels over time 422 show a gradual increase. When a gradual increase is observed, it can be inferred that air is properly flowing through the detection chamber 205, because dirt and dust are accumulating inside. Without the flow of air, dirt and dust will not accumulate on the surfaces and the baseline will remain constant or flat-line.

Dirt accumulation is proportional to the specific application and condition of the fire detection device 108 for which background signal levels over time 422 are being collected. In one example, a fire detection device 108 installed in an operating room shows an increase in light detected that is slower than that of a device installed in a boiler room. In another example, a fire detection device 108 with a baffle system 230 that is clogged shows a point at which the light detected no longer increases (as dirt and dust are no longer accumulating within the detection chamber 205). By monitoring and trending the rate at which a fire detection device gets dirty, it is possible to determine whether it is clogged or getting clogged.

Figure 5A:
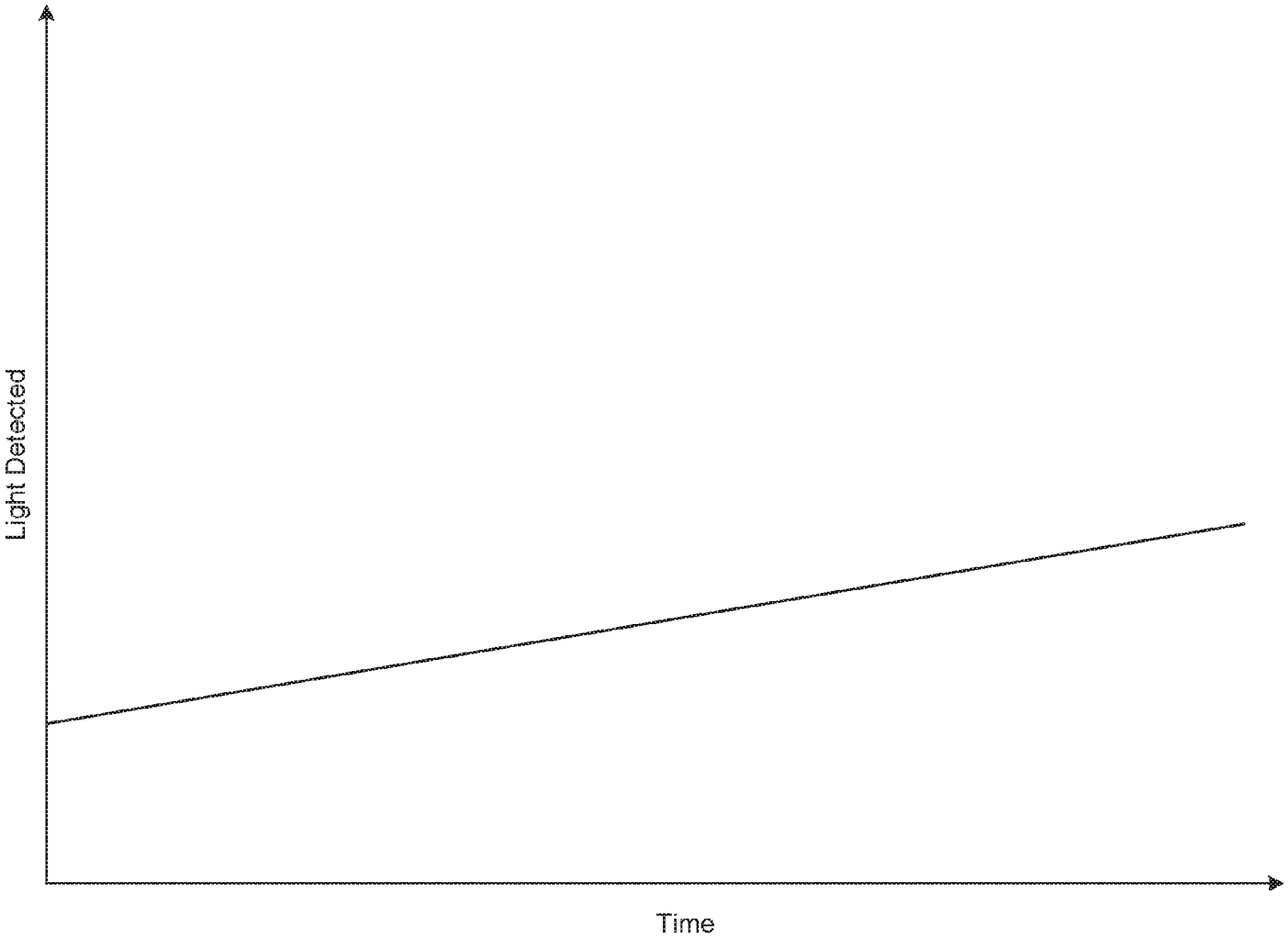
FIG. 5A is a graph illustrating a typical example of measured background signal levels over time characteristic of a chamber that is open to air flow.

FIG. 5A is a graph illustrating a typical example of measured background signal levels over time 422. These background levels present average signals for an extended time period such as over several hours or over a day. They can also be calculated based on the lowest background signals detected for some time period, such as a day. The y-axis represents the amount of light detected by the light photodetector 220 of a fire detection device 108. The x-axis represents time elapsed, such as over a month, a 6-month period, a year or several years.

In the illustrated example, the graph shows a gradual increase of the measured background signal levels over time 422. The gradual increase in light detected indicates that dirt and dust are accumulating inside the detection chamber 205 of the fire detection device 108. Therefore, it is determined that air is properly flowing through the detection chamber 205.

Figure 5B:
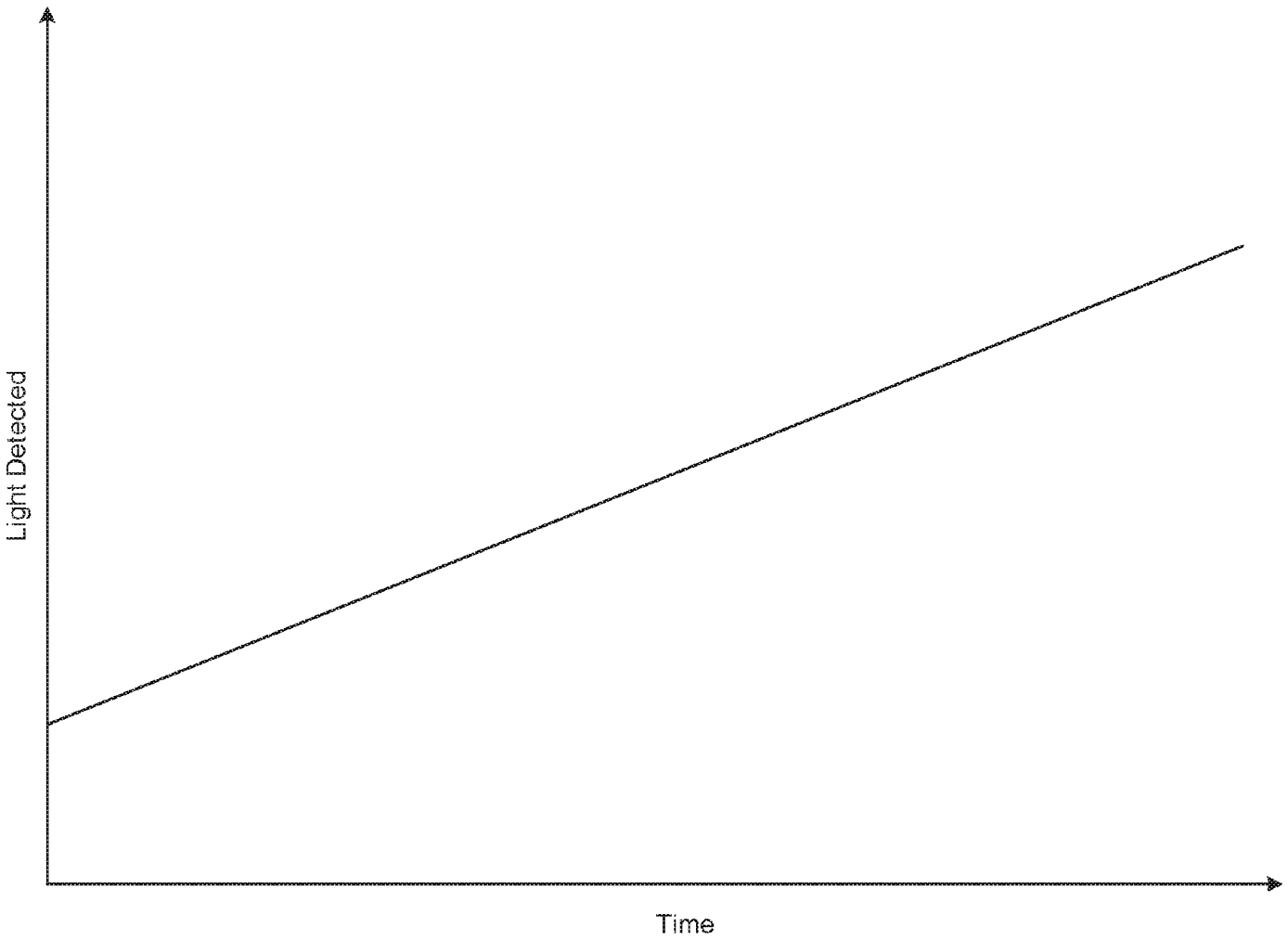
FIG. 5B is a graph illustrating an example of measured background signal levels over time, in which the light detected increases more rapidly characteristic of a chamber that is open to air flow in a dirty environment.

FIG. 5B is a graph illustrating another example of measured background signal levels over time 422. In the illustrated example, the graph shows a relatively steep increase in light detected. In this example, the steep increase indicates that dirt and dust are accumulating inside the detection chamber 205 more quickly than normal. Nevertheless, at the same time, it is determined that air is properly flowing through the detection chamber 205, because the light detected is nonetheless increasing.

Figure 5C:
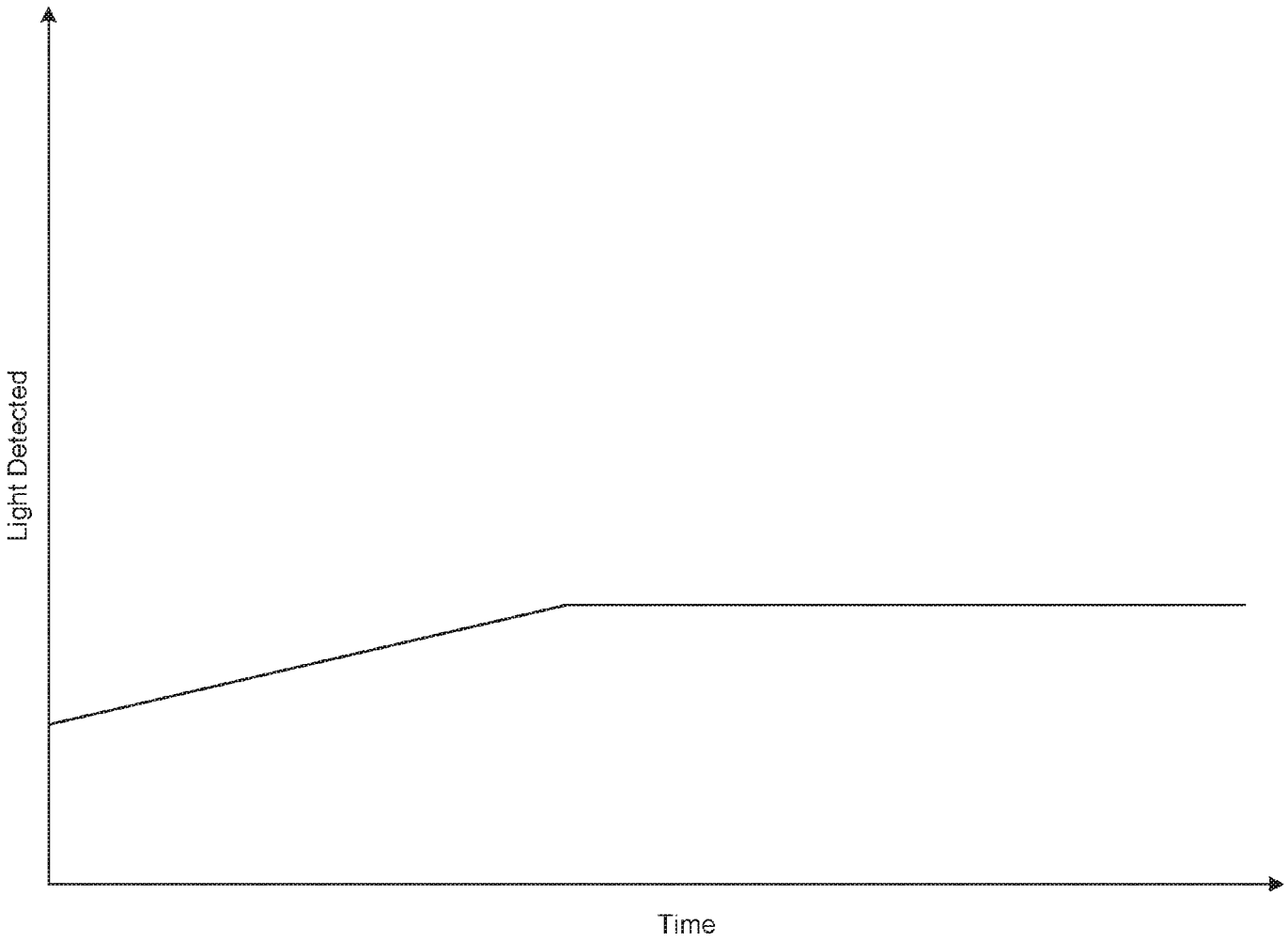
FIG. 5C is a graph illustrating an example of measured background signal levels over time, in which the light detected stops increasing (i.e. there is a change in the rate of change), characteristic of a chamber that became blocked to air flow.

FIG. 5C is a graph illustrating another example of measured background signal levels over time 422. In the illustrated example, the graph shows a point at which the light detected stops increasing, which indicates that dirt and dust are no longer accumulating inside the detection chamber 205. That is, there is a change in the rate of change, such that the rate of change decreases. It is thus determined that air is being obstructed from flowing through the detection chamber 205.

In general, the fire detection system 100 implements a self-testing capability for fire detection devices 108 by first analyzing the measured background signal levels over time 422 for each device to determine whether air is flowing through the detection chambers 205, and then by activating the self-testing system 408 of the devices to determine whether the smoke detection system 406 is operational.

In general, the process can be managed with a simple setting or process flag that determines whether the device should be put into a full alarm state. In cases where a full alarm state is requested, the process would expose the scattered light photodetector to light levels that simulate a smoke obscuration level which exceeds the alarm level for that specific device. If the non-alarm test is chosen, the process exposes the scattered light photodetector to pre-alarm light levels, which simulate smoke obscuration below the alarm level for that specific device. In one example, a fire detection device is put into a pre-alarm state without going into a full alarm state (e.g. if an alarm is triggered at 2.5, and the device is brought to a slightly lower value such as 2.3). In this way, it is possible to test the device remotely and without bypassing any of the horns or strobes, or shutting down any of the detection circuits. In this example, the fire detection system 100 remains fully operational during testing.

Figure 6:
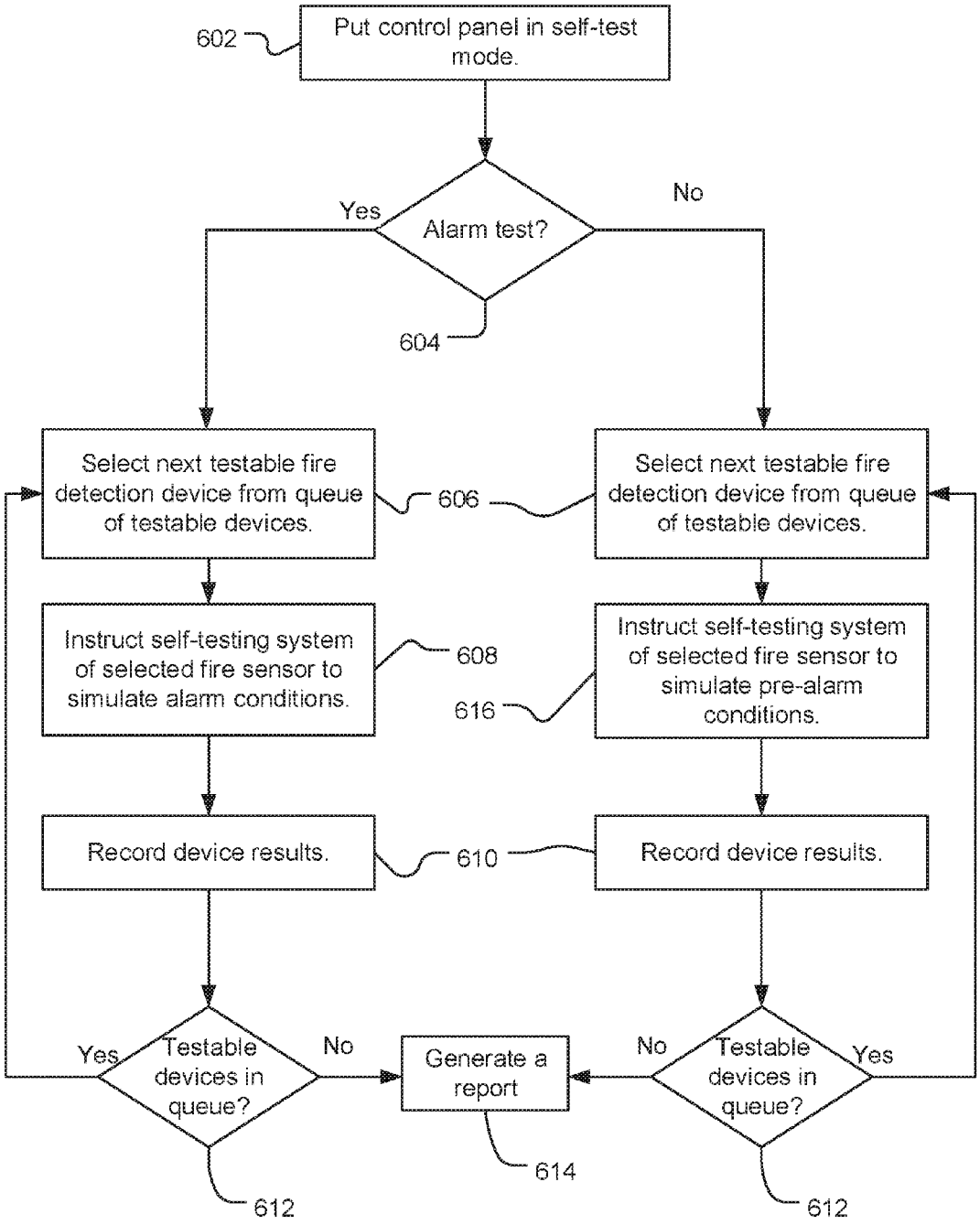
FIG. 6 is a flow diagram illustrating the automated process by which fire detection devices of a fire detection system are tested.

FIG. 6 is a flow diagram illustrating the automated process by which the fire detection devices 108 of a fire detection system 100 are tested by the control panel 102.

In step 602, the control panel 102 is placed in self-test mode, which initiates the self-test process. Step 602 can be initiated at the panel by human interaction, by the use of a system timer (daily, weekly, monthly, quarterly as an example) or remotely using a connected infrastructure similarly used in remote service, machine to machine or Internet of Things applications.

In step 604, the panel 102 reacts to the stored setting or input of the user whether to perform a full alarm or not.

At this point, the testing process executed by the panel 102 requires determining the set of fire detection devices 108 to test as required by steps 606. Therefore, a list of devices that can be tested is created and managed so that all devices get tested. It is also confirmed that all of the fire detection devices have measured background signal levels over time 422 indicating that air is flowing through the detection chambers 205. If not, the devices are flagged as "Potentially Blocked" or "New Device Insufficient trend data" depending on the state.

Figure 7:
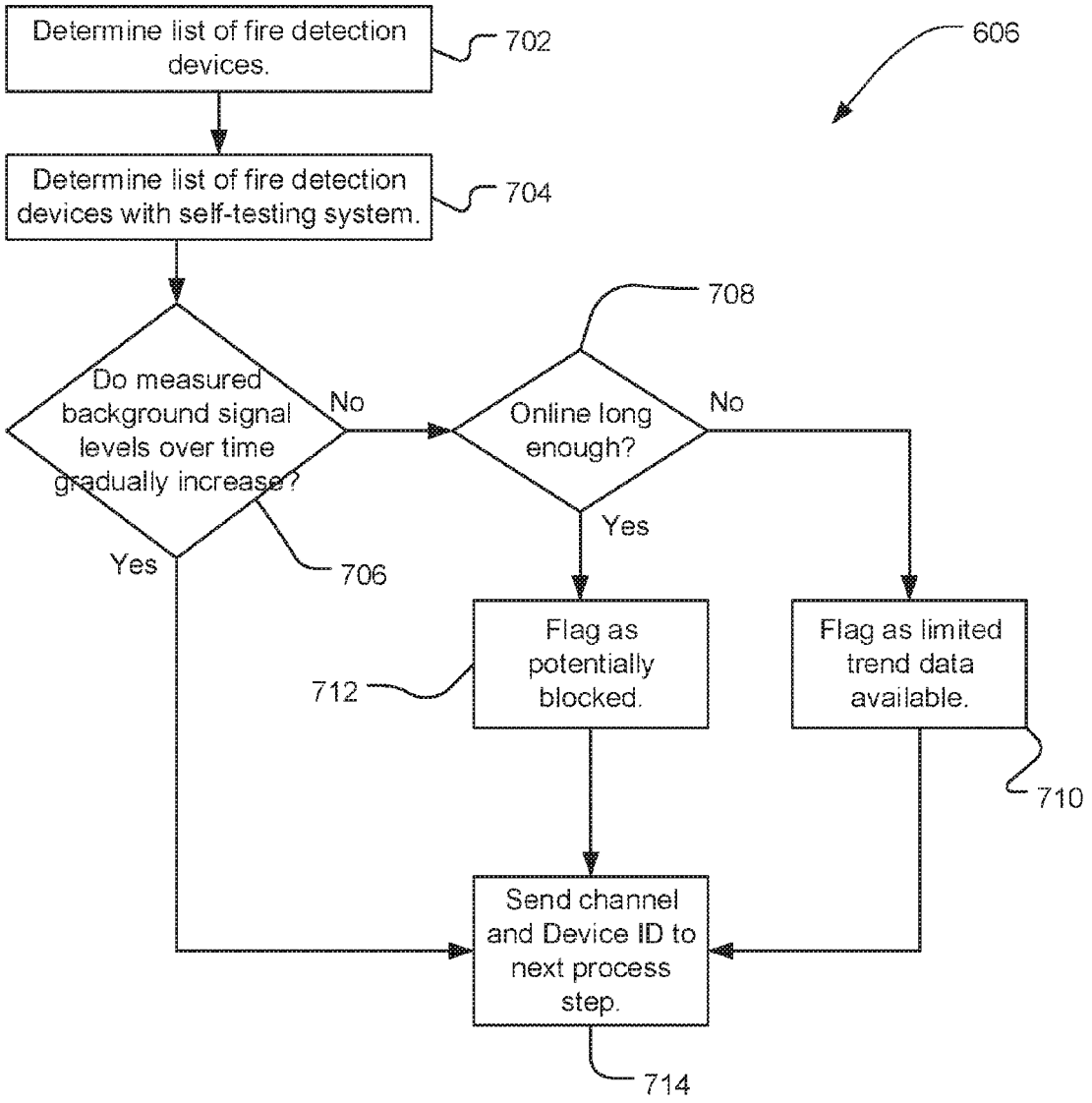
FIG. 7 is a flow diagram illustrating the process for populating a queue of testable fire detection devices and selecting the next device in the queue.

FIG. 7 is a flow diagram illustrating the process for populating a queue of testable fire detection devices 108 and selecting the next device in the queue by the control panel.

In step 702, a set of fire detection devices 108 installed in the fire detection system 100 is generated by the panel 102.

In step 704, a subset of installed fire detection devices 108 that include a self-testing system 408 is then determined by the panel 102.

In step 706, for the next device in the queue, the panel 102 determines whether the measured background signal level over time 422 as maintained by the analytics system 410 gradually increases (and therefore whether air is flowing through the detection chamber 205 of the device). This is performed by the analytics system 410 analyzing the trends in the background light levels detected over weeks, or over months, and/or over years. If an increase or trend is observed that is characteristic of a chamber that is open to airflow, the channel and device ID are sent to the next process step in step 714.

If, on the other hand, an increase is not observed, in step 708 it is determined whether the fire detection device 108 has been online for enough time to have a meaningful measured background signal level over time 422. If not, in step 710, the fire detection device 108 is flagged as having limited trend data available such as if the fire detection device has only been online for a month or less, or a year or less, in specific examples. In contrast, if the fire detection device 108 is determined to have been online for enough time, in step 712, the fire detection device is flagged as being potentially blocked (air is not flowing through the detection chamber 205). In either case, the device is then returned to the next process step in step 714.

Returning to FIG. 6, if the test was determined to be a pre-alarm test in step 604, in step 616, the self-testing system 408 of the fire detection device 108 is instructed to simulate pre-alarm conditions. If, on the other hand, the test was determined to be an alarm test in step 604, in step 608, the self-testing system 408 of the device is instructed to simulate alarm conditions.

For the alarm test scenario, the current alarm-at value for the fire detection device 108 is determined. The alarm-at value is the threshold at which it is determined that smoke is present and a full alarm state is initiated. The fire detection device 108 is then tested at a test level just below and just above the alarm-at level. This allows for verification of value changes in the observed smoke obscuration level in both the pre-alarm and alarm state. The current methodology using canned smoke is uncontrolled and incapable of repeatedly and predictably performing this pre-alarm and alarm level verification. The small sub processes within this test sequence are used to determine how much simulated smoke to apply based on the current reading. Basically, a device that currently reports it is at 30% of its alarm-at level (due to dirt, dust or moisture in its environment) needs less external stimulus than a detector at 0%. Current reading is different than the background or baseline reading. Background is a long-term average that moves slowly and effectively reports the level of dirt and dust buildup on the chamber 205 and optics 220, 222. Current reading reacts to environmental conditions real-time. A rise in the current reading is in response to a stimulus like dirt, smoke and or in the case of the invention, the simulated smoke resulting from the position of the reflective surface 228 or the active state of the second light source 238.

Figure 8:
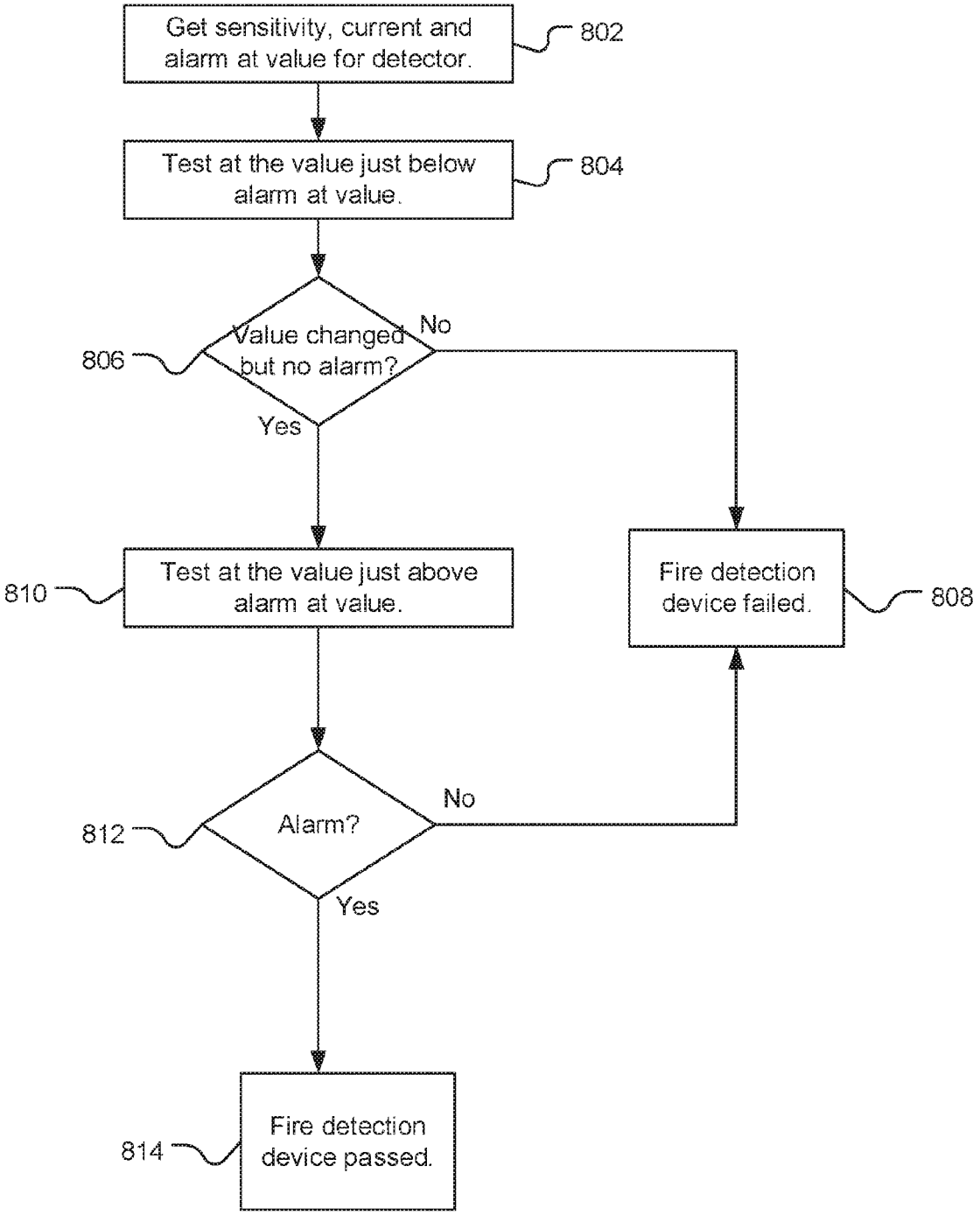
FIG. 8 is a flow diagram illustrating the process for testing fire detection devices using simulated pre-alarm and alarm conditions.

FIG. 8 is a flow diagram illustrating the process for testing fire detection devices 108 using simulated pre-alarm and alarm conditions performed by the control panel 102.

In step 802, the sensitivity, current and alarm-at values for the fire detection device 108 are determined by the control panel 102.

Figure 9:
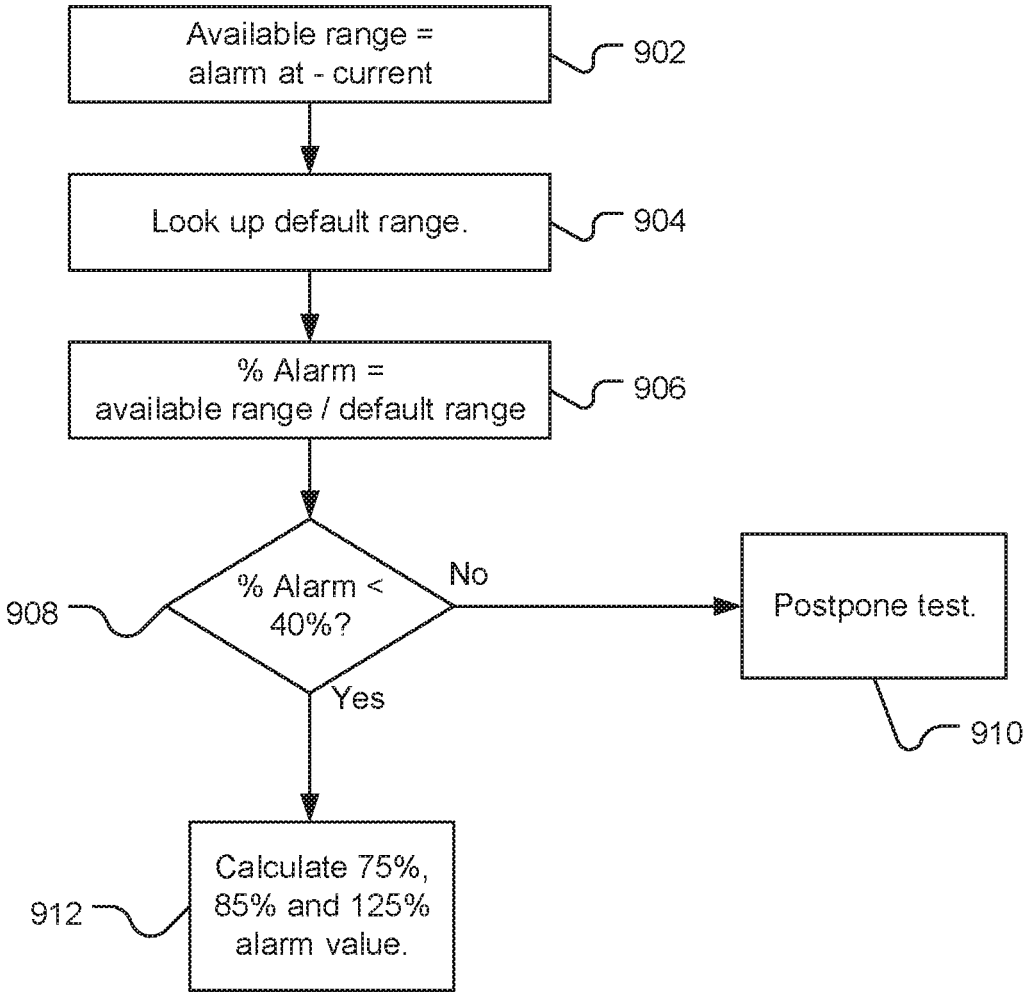
FIG. 9 is a flow diagram illustrating the process for determining the pre-alarm and alarm test values.

FIG. 9 is a flow diagram illustrating the process for determining the pre-alarm and alarm test values performed by the control panel 102. In step 902, the available range is calculated as the alarm-at level minus the current or background light level. In step 904, the default range is determined. The default range is a typical range of a device installed in the same conditions as the fire detection device 108 being tested. In step 906, a % alarm value is calculated as the available range divided by the default range. In step 908, it is determined whether the % alarm value is less than 40%. If it is not less than 40%, in step 910 the test is postponed. If the % alarm value is less than 40%, in step 912, 75%, 85% and 125% of the alarm-at value are calculated. Step 908 is performed to reduce the possibility of a smoke detector being tested while it is being exposed to real smoke. An alternate embodiment of this step would be to look at the slope of the current reading in relationship to the overall background trend. A current reading that is rising significantly faster than the background (order of magnitude or more) would be indicative of a potential fire condition.

Returning to FIG. 8, in step 804, the fire detection device 108 is tested using a test value just below the alarm-at value. In step 806, it is determined whether the amount of light detected changed but no alarm was indicated by the fire detection device 108. If not, the fire detection device fails the test in step 808 and the control panel initiates a warning flag.

If, on the other hand, the amount of light detected changed in step 804, and no alarm was indicated, in step 810, the fire detection device 108 is tested again using a test value just above the alarm-at value.

In step 812, if an alarm is indicated by the fire detection device 108, the device passes in step 814. On the other hand, if no alarm is indicated, the device fails in step 808.

Returning to FIG. 6, the results of the test conducted in either step 608 or step 616 are recorded in step 610.

In step 612, it is determined whether there are fire detection devices 108 remaining in the queue of testable devices. If so, the process returns to step 606, and the test values are determined, and the tests conducted, for the next device.

When there are no devices remaining in the queue, a report is generated in step 614.

While this invention has been particularly shown and described with references to preferred embodiments thereof, it will be understood by those skilled in the art that various changes in form and details may be made therein without departing from the scope of the invention encompassed by the appended claims.

What is claimed is:

1. A fire detection system, comprising a fire detection device comprising a detection chamber; and an analytics system for analyzing performance of the detection chamber of the fire detection device and determining whether the detection chamber is open to the flow of air from the ambient environment; and wherein the analytics system tracks the performance of the detection chamber over time and determines whether the detection chamber is potentially blocked based on change in the rate of change in a background signal.

2. The system according to claim 1, wherein the analytics system tracks the performance of the detection chamber over time and determines whether the detection chamber has been operational for a long enough period to determine whether the detection chamber is potentially blocked.

3. The system as claimed in claim 1, wherein the fire detection device is a photoelectric smoke detector.

4. The system as claimed in claim 1, wherein the fire detection device further includes a self-test subsystem for testing a photoelectric detection circuit.

5. The system as claimed in claim 4, wherein the self-test subsystem includes a module for changing light received by a photodetector consistent with the presence of smoke in the detection chamber.

6. The system as claimed in claim 5, wherein the module is manually triggered by tool or magnet or remotely triggered from a control panel.

7. The system as claimed in claim 5, wherein the module is remotely triggered via a command sent to a control panel.

8. The system as claimed in claim 5, wherein the module comprises a movable reflective surface.

9. A fire detection system testing method, comprising an analytics system analyzing performance of a detection chamber of a fire detection device over time;

the analytics system determining whether the detection chamber is open to the flow of air from the ambient environment by tracking the performance of the detection chamber over time and determining whether the detection chamber is potentially blocked based on change in the rate of change in a background signal;

the fire detection device initiating a self-test of a photoelectric detection circuit by activating a self-test subsystem; and using results to pass or fail the fire detection device based on the determination of whether the detection chamber is open and the self-test.

10. The method according to claim 9, further comprising reporting the results of pass and fail of the first detection device at a panel or via a report retrieved from the panel either locally or remotely.

11. The method as claimed in claim 9, wherein the fire detection device is a photoelectric smoke detector.

12. The method as claimed in claim 9, wherein the self-test subsystem tests a photoelectric detection circuit in the detection chamber.

13. The method as claimed in claim 12, wherein the self-test subsystem includes a module for changing light received by a photodetector consistent with the presence of smoke.

14. The method as claimed in claim 13, wherein the module is manually triggered by tool or magnet or remotely triggered from a control panel.

15. The method as claimed in claim 13, wherein the module comprises a movable reflective surface.

16. The system as claimed in claim 13, wherein the module is remotely triggered via a command to a control panel.

17. A fire detection system, comprising a fire detection device comprising a detection chamber; and an analytics system for analyzing performance of the detection chamber of the fire detection device in response to a remote trigger command sent to a control panel of the fire detection device, the analytics system determining whether the detection chamber is open to the flow of air from the ambient environment by tracking the performance of the detection chamber over time and determining whether the detection chamber is potentially blocked based on change in the rate of change in a background signal.

18. The system according to claim 17, wherein the analytics system tracks the performance of the detection chamber over time and determines whether the detection chamber has been operational for a long enough period to determine whether the detection chamber is potentially blocked.

19. The system according to claim 17, wherein the fire detection device is a photoelectric smoke detector.

20. The system according to claim 17, wherein the fire detection device further includes a self-test subsystem for testing a photoelectric detection circuit.

21. The system as claimed in claim 20, wherein the self-test subsystem includes a module for changing light received by a photodetector consistent with the presence of smoke in the detection chamber.

22. The system as claimed in claim 21, wherein the module comprises a movable reflective surface.

* * * * *